United States Patent [19]

Borrmann et al.

[11] Patent Number: 4,787,873

[45] Date of Patent: Nov. 29, 1988

[54] MODULAR COIN BANK

[76] Inventors: Lela R. Borrmann; Judson P. Borrmann, both of 647 S. Bermuda Cir., Mesa, Ariz. 85206

[21] Appl. No.: 134,372

[22] Filed: Dec. 17, 1987

[51] Int. Cl.[4] ..... A45C 1/12

[52] U.S. Cl. ..... 446/8; 232/4 R; 232/44; 194/344; 193/DIG. 1; 193/29

[58] Field of Search ..... 446/8–13, 446/89, 168; 232/4 R, 5, 9, 44; 194/344, 346; 193/DIG. 1, 29; 206/0.8; D99/35, 34; D34/11

[56] References Cited

U.S. PATENT DOCUMENTS

| | | | |
|---|---|---|---|
| 9,858 | 9/1881 | Imlay | 232/9 |
| D. 160,133 | 9/1950 | Thompson | D34/11 |
| D. 169,270 | 4/1953 | Matalon | 446/8 X |
| D. 251,323 | 3/1979 | Phipps | D99/35 |
| D. 283,075 | 3/1986 | Spirk, Jr. et al. | D99/34 |
| 500,848 | 7/1893 | Breul | 446/8 |
| 2,510,884 | 6/1950 | Greene | 446/8 |
| 2,749,656 | 6/1956 | Reynolds | 446/8 |
| 2,771,707 | 11/1956 | Ginsberg | 446/8 |
| 3,143,285 | 8/1964 | Fulton | 232/5 |
| 3,167,165 | 1/1965 | Danielson et al. | 194/344 X |
| 3,313,477 | 4/1967 | Brown | 232/5 |
| 4,170,839 | 10/1979 | O'Donnell | 446/89 |

FOREIGN PATENT DOCUMENTS

| | | | |
|---|---|---|---|
| 2075960 | 11/1981 | United Kingdom | 193/DIG. 1 |

*Primary Examiner*—Mickey Yu

*Attorney, Agent, or Firm*—LaValle D. Ptak

[57] ABSTRACT

A modular coin bank permits construction of a variety of different geometric patterns of coin guideways for feeding coins from a receiving member to a coin storage base. The base has at least two coin receiving slots in it, and different geometric shapes of hollow guideway members are releasably interconnected together to form intricate pathways from a single coin receiving slot to the coin entry slots in the base. A coin dropped in the coin receiving slot takes one or another of the various pathways to the base. The various members are made of transparent material to permit observation of the path taken by a coin in its fall from the opening in the coin receiving member to the coin storage base of the bank.

22 Claims, 3 Drawing Sheets

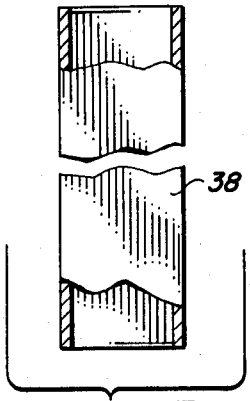
FIG. 9
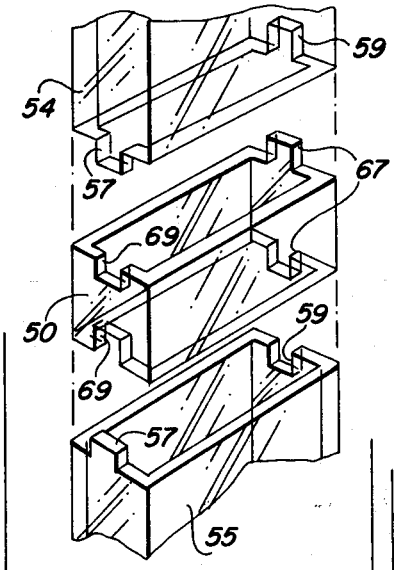
FIG. 11
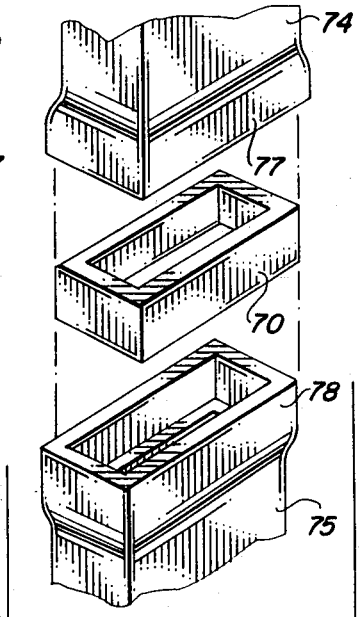
FIG. 12
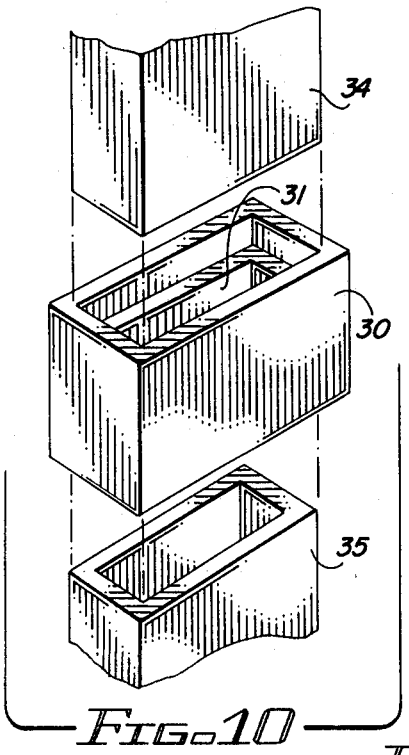
FIG. 10
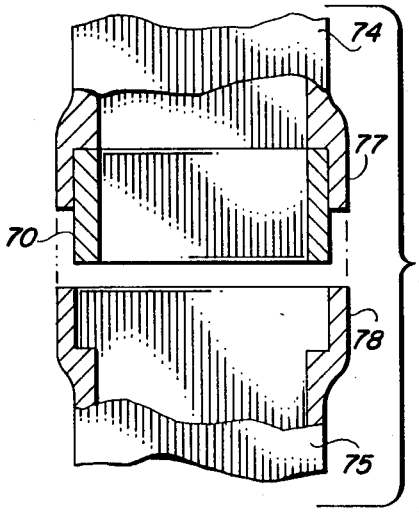
FIG. 13
FIG. 15
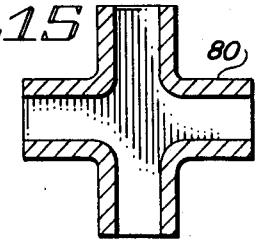
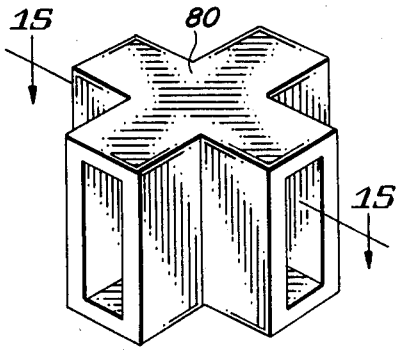
FIG. 14
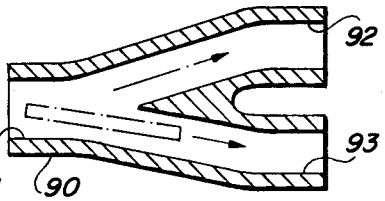
FIG. 16
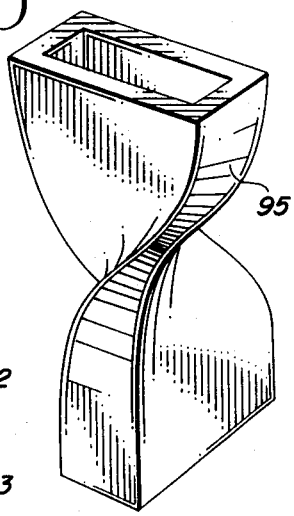
FIG. 17

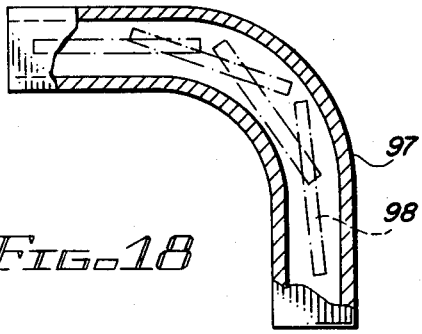
FIG. 18
FIG. 19
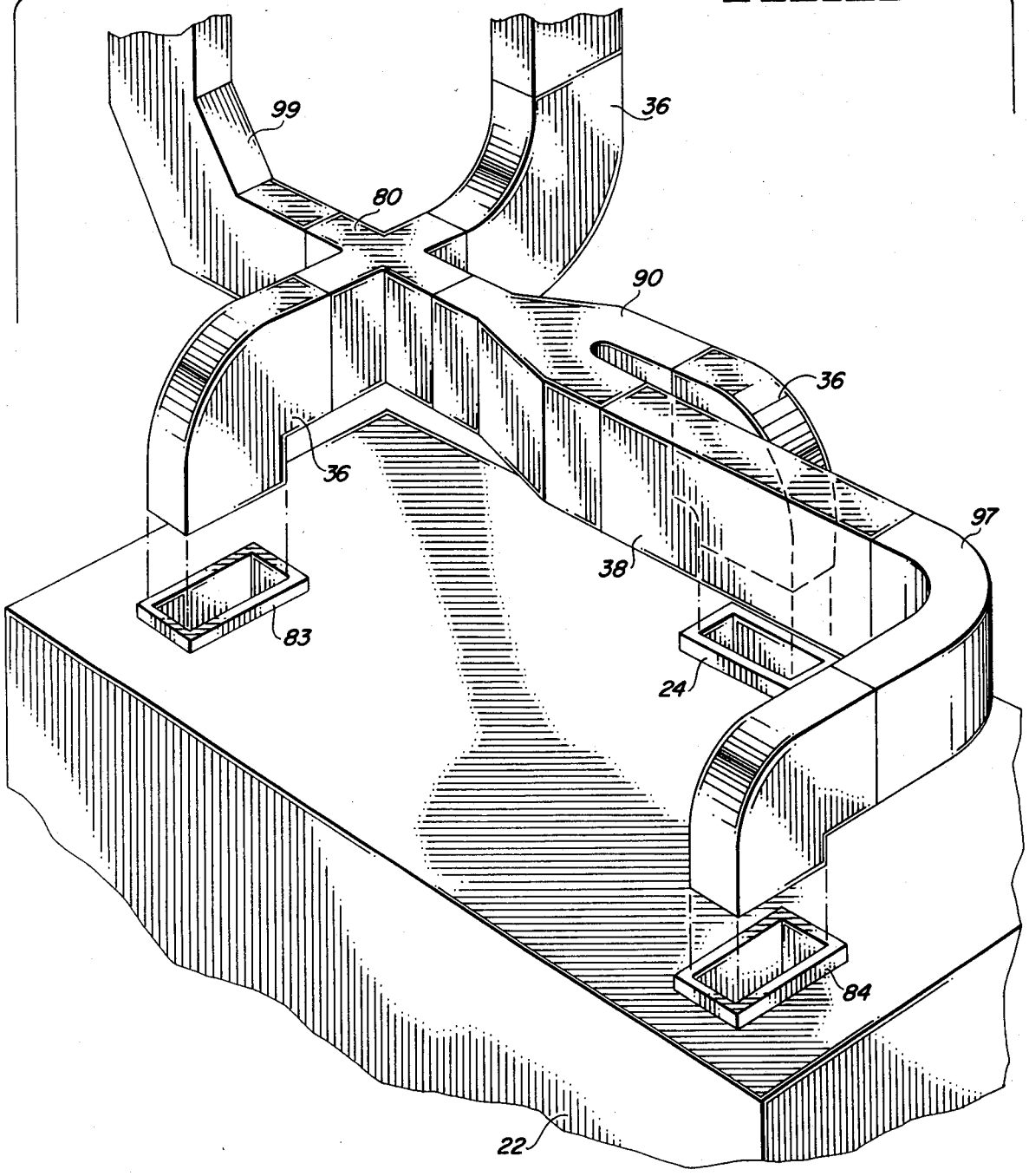

MODULAR COIN BANK

BACKGROUND

This invention relates generally to a toy bank for saving coins and specifically is directed to coin banks having transparent parts to enable the user to observe the progress of coins moving from a coin entry slot through a path to a receptacle for the coins.

Savings banks for coins are well known and have been used for many years, particularly to encourage savings among small children. Some of the earliest and most popular coin banks comprise ceramic containers in interesting shapes such as the well known "piggy-bank". Over the years, different configurations of savings banks have been introduced utilizing different forms and adding innovations to create an entertainment value or a curiosity builder in conjunction with the use of the bank and the depositing of coins in it. Some of these early configurations involved complex moving mechanical parts which render them relatively expensive and susceptible to failure. Other coin savings banks have been developed to cause the coins to move through various paths through a chute or channel to the final receptacle. Typically, banks of this type are made of transparent material to permit observation of the path of the coin as it moves through the chute or guide channel after it is deposited in the entry slot.

A variety of configurations have been devised to stimulate the interest of a child in placing money in a savings bank and thereby saving money. An early patent directed to a simple approach to stimulating such interest is the Patent to Breul U.S. Pat. No. 500,848. This patent is directed to a bank in the shape of a house which includes a coin slot in the roof for receiving coins of different denominations. All of the coins fall into a common collection area.

Three patents directed to transparent coin banks which separate the coins in accordance with their type or denomination are the Patents to Brown U.S. Pat. No. 3,313,477; Thompson U.S. Pat. No. Des. 160,133; and Spirk U.S. Pat. No. Des. 283,075. The Brown Patent is directed to a transparent bank in which the deposited coins are automatically segregated and counted. They are stacked in compartments according to the type of coin (pennies, nickels, dimes, etc.) and are visible from the point of deposit through the sorting stages to the stacking of the coins in the segregated stacks. The Thompson Patent simply is a transparent patent which has four separate columns provided for different denominations of coins. It is necessary to insert the proper coin at the top of each column for deposit in the bank. The Spirk Patent is an ornamental design for a transparent savings bank which appears to have some type of sorting mechanism in it, although this cannot readily be ascertained from an examination of this patent. The banks of all three of these patents are of fixed construction, that is, no variations in their form is possible or contemplated.

A different approach to providing an incentive for saving coins is disclosed in the Patent to Fulton U.S. Pat. No. 3,143,285. The bank disclosed in this patent has at least two (2) coin receiving compartments, each contemplated to be allotted to a different individual. The object of this bank is to provide an incentive or encouragement, by means of competition, to save by matching deposits coin-for-coin.

Savings banks which are designed to create interest in savings by means of observation of the movement of a coin from the coin receiving slot through a channel or guide, are disclosed in the Patents to Reynolds U.S. Pat. No. 2,749,656 and Ginsberg U.S. Pat. No. 2,771,707. The bank disclosed in the Reynolds Patent has an inclined, longitudinally extending rack through which the coin travels. During the travel, the coin rotates about a transverse axis passing through its center, so that it spins on its way from the point of deposit to the ultimate receptacle.

The Ginsberg Patent discloses a bank which has various baffles in the path from the coin entry slot to cause the coin either to be delivered out through a central opening or to be retained within a receptacle at the bottom of the bank. If the coin is delivered out through the opening, the child may redeposit the coin. The baffle section of the bank is transparent, so that the path of the coin may be observed by the child making the deposit.

A final modular bank which also serves a second (actually primary) purpose of teaching spelling, is disclosed in the Patent to Greene U.S. Pat. No. 2,519,884. This patent primarily is directed to simple spelling blocks which are interconnected together to form a picture of the word spelled, as well as presenting the letters of the word in their proper sequence. One version has each of the blocks made in the form of separate savings banks, which may be configured to receive coins of different sizes, if desired. The collection slots are simply provided at the top of each of the individual blocks; and the blocks are not selectively configurable, that is there is only one configuration which can be made to interconnect them together. In addition, the blocks are not transparent and the coins deposited in the different blocks do not fall into a common collection receptacle.

It is desirable to provide a savings bank which stimulates interest in a child to place coins in the bank and thereby save them, while at the same time providing additional interest in permitting the child to configure the bank in a variety of different forms, so that his or her interest level is sustained.

SUMMARY OF THE INVENTION

Accordingly it is an object of this invention to provide an improved coin savings bank.

It is an additional object of this invention to provide an improved modular coin savings bank.

It is another object of this invention to provide an improved modular coin savings bank which can be configured and reconfigured by the user.

It is a further object of this invention to provide a modular coin savings bank which includes multiple paths for coins to take from an entry slot to a receptacle in which the coins are stored.

It is yet another object of this invention to provide an improved modular coin savings bank which has a plurality of hollow guideway members which are selectively connected together by the user in a variety of different patterns between a coin receiving member and a receptacle to provide various paths between the coin receiving member and the receptacle.

In accordance with a preferred embodiment of the invention, a modular coin bank has a coin storage base with at least two spaced coin entry slots in it. A hollow coin receiving member, with a coin entry end and a coin discharge end, then is interconnected with the slots in the storage base through various hollow guideway members of different shapes, including at least one guideway splitting member which provides first and second exit ends from a single input end to create at least two alternate paths for coins to travel between the receiving member and the slots in the base.

BRIEF DESCRIPTION OF THE DRAWINGS

FIGS. 6 through 9 illustrate other components which are used in the structure of FIG. 1 and which are not shown in FIG. 5;

FIG. 10 illustrates a detail of the embodiment of FIG. 1;

FIGS. 11 and 12 illustrate alternative techniques which may be used for interconnecting various parts together to form configurations of the type shown in FIG. 1;

FIG. 13 is a detailed partially assembled cross-sectional view of the connector shown in FIG. 12;

FIGS. 14 through 18 illustrate other components which may be used in conjunction with or as replacements for the components shown in the embodiment of FIG. 1; and FIG. 19 illustrates a different portion of configuration which may be used in conjunction with the preferred embodiment.

DETAILED DESCRIPTION

Figure 1:
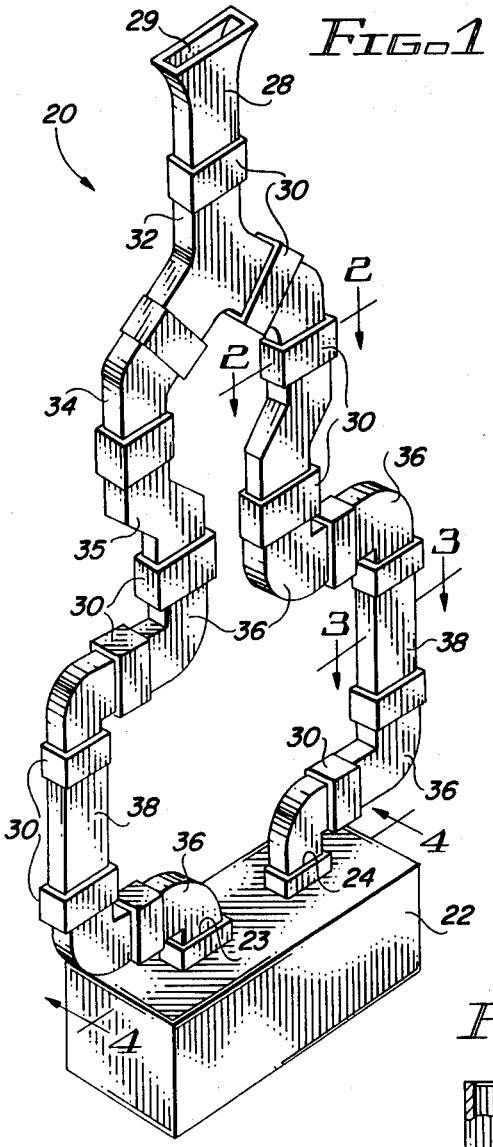
FIG. 1 is a perspective view of one configuration of a preferred embodiment of the invention.
Figure 4:
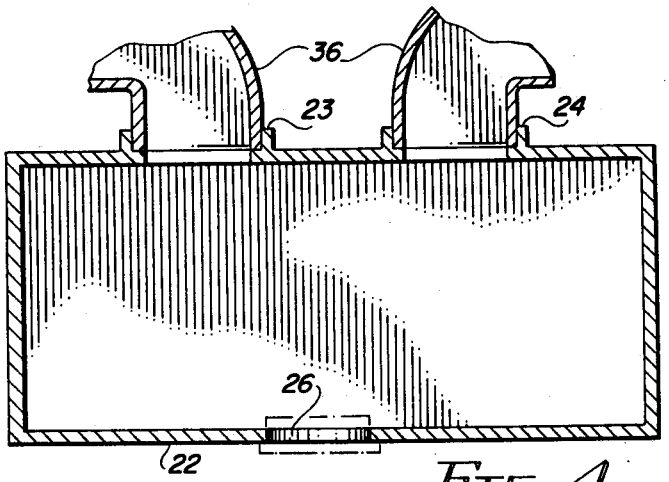
FIG. 4 is a cross-sectional view of a portion of the embodiment shown in FIG. 1, taken along the line 4—4 of FIG. 1.

Reference now should be made to the drawing in which the same or similar reference numbers are used throughout the various FIGURES to designate the same components. Consideration first should be made to FIGS. 1 through 10. FIG. 1 is a perspective view of one possible configuration of a preferred embodiment of a modular savings bank. The bank includes a coin storage base 22 in the form of a rectangular box. The base 22 has two coin receiving slots 23 and 24 (shown most clearly in FIG. 4) in its top. These slots are spaced apart and, as illustrated, lie in the same vertical plane. The box 22 may be made of either opaque or transparent material and may also include an opening 26 in the bottom, from which coins may be withdrawn. The opening 26 typically is provided with some type of seal or lock in it, so that the withdrawal of coins from the box 22 may be somewhat inhibited.

With the exception of the coin storage base 22, the rest of the components of the embodiment illustrated in FIGS. 1 through 10 ideally are made of transparent material, such as transparent plastic. In order to avoid confusing clutter of the drawings, particularly FIG. 1, the various components have been shown in solid form. FIG. 11 illustrates a variation of the embodiment as transparent parts. It should be understood, however, that all of the components illustrated in all of the FIGURES of the drawings, with the possible exception of the storage base 22, ideally are made of transparent material. The various parts which are illustrated in detail in FIGS. 3 and 5 through 10 ideally are made of molded transparent acrylic plastic, although other suitable materials may be used, if desired.

As shown in FIG. 1, the modular savings bank has a hollow coin receiving member 28 with an outwardly flared receiving opening 29 in it. This constitutes the coin input for the bank; and a coin dropped into the opening 29 of the member 28 then moves through one or the other of a pair of left-hand and right-hand paths to ultimately be deposited in the storage base 22 through one or the other of the slots 23 or 24. The paths are determined by the modular construction or interconnection of a variety of slip-fit parts, at least one of which is in the form of a guideway or channel splitting member 32, to cause the alternative movement of coins through the maze or different guideways which are constructed.

Figure 2:
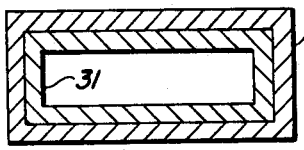
FIGS. 2 and 3 are cross-sections taken along the lines 2—2 and 3—3, respectively, of FIG. 1.
Figure 3:
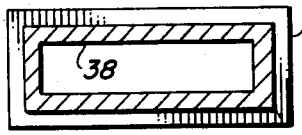
Figure 5:
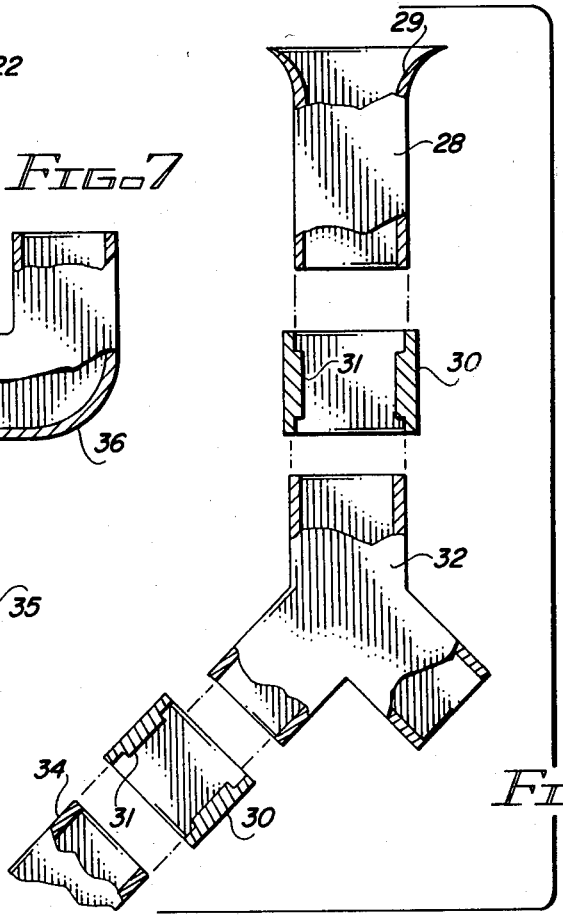
FIG. 5 is an exploded partial cross-sectional view of the assembly of FIG. 1.

As illustrated in FIG. 1, various ones of the components are interconnected together by means of slip-fit connectors 30 (shown most clearly in FIGS. 2, 5 and 10). The connectors 30 have an interior flange 31 in them terminating in shoulders adjacent each end of the connectors. The shoulders are equal in width to the wall thicknesses of the various other modular components 28, 32, 34, 36, 35 and 38, which are interconnected by the different connectors 30 to form the two different channels or guideways ultimately terminating in the slots 23 and 24. By selecting the relative dimensions of the connectors 30 and flanges 31 in this manner, the interior channels or guideways provide smooth surfaces for the paths of coins traveling through them.

In the configuration illustrated in FIG. 1, the left-hand and right-hand guideways which are provided by the two different exit ends of a "Y" shaped guideway splitting member 32, are symmetrical. In essence, the two different guideways are mirror images of one another, with identical ones of the different guideway members 34, 35, 36 and 38 (interconnected by connectors 30) being used on each side in the same relative positions.

When a coin is placed in the opening 29 of the coin receiving member 28 it falls vertically downwardly until it hits the juncture of the inverted "Y" provided by the splitting member 32. The coin then will take one or the other of the guideway paths depending upon the manner in which it strikes the inverted point of the "Y". The remainder of the travel of the coin then is through either the left-hand or right-hand guideway and may be clearly observed by the child who placed the coin in the slot 29. It is apparent that the various curves and shoulders in the parts 35, 36 and 34 will cause the coin to relatively rapidly move through the guideway.

By providing a number of each of the different parts 32, 34, 35, 36 and 38 along with an abundant supply of connectors 30, many different configurations can be constructed, so that the modular bank also becomes an interesting puzzle or building block toy as well as an incentive for saving money. The configuration which is shown in FIG. 1 is merely one of an almost limitless variety of configurations which may be employed, even with only two coin entry slots 23 and 24 in the coin storage base 22. It is readily apparent that, at the exit ends of the members 35 shown in FIG. 1, a "Y" shaped member 32 could be used in an upright orientation along with a pair of members 34 to recombine the two paths into a single path which once again could be split if desired. Obviously, additional splitting members 32 may be employed to cause four or more possible paths to be created for the movement of a coin through the device.

It is readily apparent that the internal shape of the rectangular cross-sections of the members in the various guideways should be sufficiently wide to accomodate the largest coin which is intended to be used with the bank. The depth or thickness of the cross-sections should be greater than the thickness of the coins, but not so great as to permit them to twist around or turn within the guideways. Other than this, the dimensions of the guideways are not critical.

FIG. 10 is an exploded perspective view of the connector 30, showing the manner in which the various guideway members, such as 34 and 35, slip-fit into the connector 30 to abut the shoulders on the opposite sides of the flange 31.

Reference now should be made to FIGS. 11, 12 and 13 which illustrate alternative techniques which may be used to slip-fit interconnect the modular building blocks of the guideways together in place of the connectors 30, which are shown in conjunction with FIGS. 1 through 10.

FIG. 11 illustrates another technique which may be used for releasable slip-fit interconnections of various ones of the members to form the guideways. A pair of guideway members 54 and 55, which may be considered similar to the guideway members 34 and 35, are illustrated. At each end of the members 54 and 55 a male projection 57 is formed at the center of one edge, and a female receiving slot 59 is formed on the other edge. The different pieces or members then may be interconnected together by sliding the projection 57 of one piece into the corresponding slot 59 of the next adjacent piece. When reversal of direction of the interconnections is desired, a connector 50, as illustrated in FIG. 11, is inserted between a pair of the guideway members, such as the members 54 and 55. The direction reversing connector 50 has a pair of male projections 69 on the same edge on both the input and output sides and corresponding receiving slots 69 on the opposite edge. Consequently, when a piece 50 is placed between a set of guideway members, the members may then be used to reverse direction in the construction of the maze or guideways between the receiving member 28 and the storage base 22.

Figure 6:
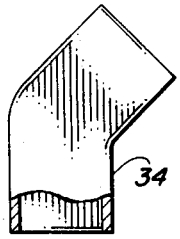
Figure 7:
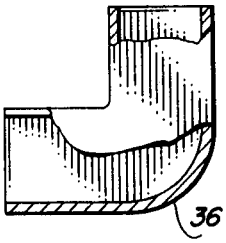
Figure 8:
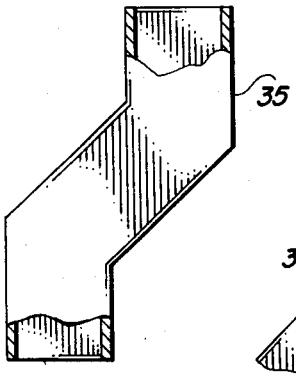

FIGS. 12 and 13 are directed to another technique which may be used to interconnect the various parts. A pair of guideway members 74 and 75, which may be considered comparable to the guideway members 34 and 35 of FIGS. 1, 6 and 8, are illustrated. These guideway members 74 and 75, however, differ from the members 34 and 35 through the provision of enlarged ends or flanges 77 and 78 on the exit ends and input ends, respectively. This forms a shoulder, as seen through the open end 78 of guideway member 75, against which an insert connector 70 rests. The manner in which the connector 70 is seated within the flanges 77 and 78 is shown most clearly in FIG. 13.

FIGS. 14 through 18 illustrate four other guideway member shapes which may be used in conjunction with variations of the invention to build guideways in more than one plane between the coin receiving member 28 and the storage base 22. FIGS. 14 and 15 illustrate a cross-path member 80. FIG. 16 illustrates a splitting member 90 which functions in a manner similar to the guideway splitting member 32, but which causes the coins to be guided from a single inlet end 91 to different planes at a pair of exit ends 92 and 93. FIG. 17 illustrates a member 95 with a 180° twist in it for changing the orientation of the guideway from a first plane to a plane perpendicular to the first plane. Finally, FIG. 18 illustrates a guideway member 97 which may be used to turn a coin 98 about its central axis. The member 18 is useful in conjunction with others of the members for changing the plane of the path of travel of a coin.

FIG. 19 is an illustration of a portion of a maze which may be employed to utilize some of the members shown in FIGS. 14 through 18, as well as using different ones of the guideway members which have been discussed previously in conjunction with the embodiment shown in FIG. 1. As is readily apparent from an examination of FIG. 19, coins may be guided through multiple paths in multiple planes to ultimately be deposited in the coin storage base 22. The number of coin receiving slots (such as 23, 24, 83, 84) in the base 22, and the orientation of these slots, is selected in accordance with the particular types and orientations of guideway members which may be slip-fit interconnected together to form the maze. Obviously, the various parts must ultimately interconnect with a single input coin receiving member 28, and members such as the members 95, 90 and 80 then are used to guide the coins through the various paths. Ultimately different guideway members are interconnected together to terminate in the various slots 23, 24, 83, 84 in the top of the coin storage base 22.

The foregoing description is to be considered as illustrative only and not as limiting the invention to the specific embodiments shown and described. If desired, the invention may be added to a suitable coin sorting device. Other guideway member shapes may be employed and different connectors may be used without departing from the true scope of the invention. Various other changes and modifications coming within the scope of the invention will occur to those skilled in the art.

We claim:

1. A modular coin bank including in combination:

a coin storage base having at least first and second coin entry slots therein;

a hollow coin receiving member having a coin entry end and a coin discharge end therein;

a plurality of hollow guideway members having input ends and exit ends therein;

at least one hollow guideway splitting member having an input end and first and second exit ends therein; and means for interconnecting said coin receiving member, said guideway splitting member, and said plurality of guideway members with said first and second coin entry slots in said storage base to provide at least two alternate paths for coins to travel between said coin receiving member and said base.

2. The combination according to claim 1 wherein said coin receiving member, said hollow guideway members and the ends of said guideway splitting member all have an elongated rectangular cross-section having the same dimensions, with a width sufficient to accomodate coins of various diameters and having a depth selected to prevent coins from turning over within said members.

3. The combination according to claim 2 wherein said interconnecting means effect slip-fit interconnections between said coin receiving member, said guideway splitting member, and said plurality of guideway members.

4. The combination according to claim 3 wherein at least a portion of said plurality of hollow guideway members are transparent to permit observation of a coin moving therethrough.

5. The combination according to claim 4 wherein said hollowcoin receiving member, said plurality of hollow guideway members, and said hollow guideway splitting member are made of transparent material.

6. The combination according to claim 5 wherein said guideway splitting member is generally in the form of a "Y".

7. The combination according to claim 6 wherein said first and second coin entry slots of said coin storage base, said coin receiving member, said plurality of hollow guideway members, and said hollow guideway splitting member all lie in the same plane.

8. The combination according to claim 7 wherein at least some of said plurality of hollow guideway members ara constructed such that the path for coins moving therethrough from the input end to the exit end thereof is other than a straight line.

9. The combination according to claim 8 wherein said interconnecting means comprise hollow connecting members having an internal cross-section in the form of an elongated rectangle of the same dimensions as said cross-section of said guideway members.

10. The combination according to claim 1 further including at least one plane-changing guideway member having an input end and an exit end therein for interconnection with others of said plurality of hollow guideway members for changing the orientation of coins moving therethrough from a first plane to a second plane; and wherein said coin storage base has at least one coin entry slot therein for receiving coins in said first plane and a second slot spaced from said first slot for receiving coins in said second plane.

11. The combination according to claim 10 wherein said interconnecting means effect slip-fit interconnections between said coin receiving member, said guideway splitting member, and said plurality of guideway members.

12. The combination according to claim 11 wherein at least a portion of said plurality of hollow guideway members are transparent to permit observation of a coin moving therethrough.

13. The combination according to claim 12 wherein at least some of said plurality of hollow guideway members are constructed such that the path for coins moving therethrough from the input end to the exit end thereof is other than a straight line.

14. The combination according to claim 13 wherein said hollow coin receiving member, said plurality of hollow guideway members, and said hollow guideway splitting member are made of transparent material.

15. The combination according to claim 1 wherein said interconnecting means effect slip-fit interconnections between said coin receiving member, said guideway splitting member, and said plurality of guideway members.

16. The combination according to claim 15 wherein said coin receiving member, said plurality of hollow guideway members, said guideway splitting member, and said interconnecting means each are constructed at least in part of transparent material.

17. The combination according to claim 16 wherein said hollow coin receiving member, said plurality of hollow guideway members, and said hollow guideway splitting member are made of transparent material.

18. The combination according to claim 1 wherein said interconnecting means includes corresponding male and female connector elements on said coin receiving member, said plurality of guideway members, and said guideway splitting member; and further including at least one separate interconnecting member for permitting 180° orientation reversal between said guideway members when said separate interconnecting means is placed between the exit end of one guideway member and the input end of another.

19. The combination according to claim 1 wherein at least a portion of said plurality of hollow guideway members are transparent to permit observation of a coin moving therethrough.

20. The combination according to claim 19 wherein said hollow coin receiving member, said plurality of hollow guideway members, and said hollow guideway splitting member are made of transparent material.

21. The combination according to claim 1 wherein said guideway splitting member is generally in the form of a "Y".

22. The combination according to claim 21 wherein said first and second coin entry slots of said coin storage base, said coin receiving member, said plurality of hollow guideway members, and said hollow guideway splitting member all lie in the same plane.

* * * * *